US005090674A

United States Patent [19]

Ozawa

[11] Patent Number: 5,090,674

[45] Date of Patent: Feb. 25, 1992

[54] IMAGE FORMING APPARATUS

[75] Inventor: Takashi Ozawa, Ichikawa, Japan

[73] Assignee: Canon Kabushiki Kaisha, Tokyo, Japan

[21] Appl. No.: 512,538

[22] Filed: Apr. 18, 1990

Related U.S. Application Data

[63] Continuation of Ser. No. 353,701, May 18, 1989, abandoned.

[30] Foreign Application Priority Data

May 20, 1988 [JP] Japan ..... 63-123682

[51] Int. Cl.[5] ..... G03G 15/00

[52] U.S. Cl. ..... 271/3.1; 271/149; 271/272; 355/322

[58] Field of Search ..... 355/322; 271/3.1, 202, 271/203, 270, 272, 149-151

[56] References Cited

U.S. PATENT DOCUMENTS 4,172,655 10/1979 Wood ..... 355/26
4,220,324 9/1980 Weller ..... 271/151
4,777,498 10/1988 Kasamura et al. ..... 346/150
4,805,890 2/1989 Martin ..... 271/216 X

FOREIGN PATENT DOCUMENTS 0266946 5/1988 European Pat. Off. .
0303276 2/1989 European Pat. Off. .
3336820 5/1984 Fed. Rep. of Germany .
62-293258 12/1987 Japan .

*Primary Examiner*—R. L. Moses
*Attorney, Agent, or Firm*—Fitzpatrick, Cella, Harper & Scinto

[57] ABSTRACT

The present invention relates to an image forming apparatus comprising image forming means for forming an image on a sheet, sheet stacking means for successively stacking sheets on which the image is formed by the image forming means, with shifting by a predetermined amount in a sheet feeding direction one from the other, feeding means for feeding the sheet one by one from a sheet stack obtained by stacking the sheets with shifting by the predetermined amount one from the other, conveying means for conveying the sheet stack formed by the sheet stacking means in normal and reverse directions between the sheet stacking means and the feeding means, and control means for controlling the conveying means in such a manner that the conveying means returns said sheet stack from the feeding means to the sheet stacking means to stack the sheets on which the image is formed by the image forming means after they have been fed by the feeding means, for obtaining a new sheet stack.

23 Claims, 12 Drawing Sheets

IMAGE FORMING APPARATUS

This application is a continuation of application Ser. No. 353,701 filed May 18, 1989 now abandoned.

BACKGROUND OF THE INVENTION

1. Field of the Invention

The present invention relates to an image forming apparatus such as a copying machine.

2. Related Background Art

Since various kinds of originals or manuscripts need to be copied and various kinds of images are requested by operators, not only a popular monochromatic copy which is normally and widely used, but also colored copies (that is, an image is formed with colors such as red, blue and the like by means of an image forming apparatus) have recently been requested.

In order to meet such requests, as shown in FIG. 2, an image forming apparatus wherein a plurality of developer containers each including developer of a different color such as red, blue, green and the like are used and these developer containers can be automatically changed as needed by an operator, thus permitting the formation of multi-colored images.

In FIG. 2, an original 2 positioned on an original support glass 1 is illuminated by a lamp 3 to create a light image. The light image is directed to a photosensitive drum 11 through an optical system comprising reflection mirrors 4, 5, 6, 7, 8, and 9, and a zoom lens 10. The lamp 3, mirror 4 and mirrors 5, 6 are shifted at a predetermined speed in a direction shown by an arrow, to scan the original 2. Since the photosensitive drum 11 is rotated in a direction shown by an arrow, after charges are uniformly applied to an outer surface of the drum by a primary charger 12, electrostatic latent images corresponding to the original images are sequentially formed on the surface of the drum 11.

In association with the photosensitive drum 11, color developer containers 13B, 13C, 13D each containing colored toner (such as red toner, blue toner, green toner) and a black developer container 13A containing black toner are arranged. These developer containers 13A, 13B, 13C and 13D can be shifted in an up-and-down direction and in a direction shown by an arrow. The developer container corresponding to a desired color image is shifted to a desired level and then is shifted toward the photosensitive drum 11 to a developing station, where the electrostatic latent image is visualized by the colored toner contained in such developer container. The visualized or developed image is transferred onto a sheet, i.e., transfer paper 17 by a transfer charger 15. Thereafter, the photosensitive drum 11 is rotated to a cleaning station, where the residual toner remaining on the drum surface is removed by a cleaner 16 to prepare for the next copying cycle.

The transfer paper or sheet 17 can be fed into the copying machine by any one of the following methods.

In a first method, the transfer papers 17 stacked in a sheet cassette 18 are fed one by one toward a pair of rollers 20 by means of a pick-up roller 19. If a plurality of transfer papers 17 are fed in an overlapped condition to the paired rollers 20, these rollers can separate, an uppermost transfer paper from the others to feed only one transfer paper into the machine. After passing through the paired rollers 20, the transfer paper 17 is fed to resist rollers 23 through guide plates 21, 22, a pair of feed rollers 50 and guide plates 52, 53, 51.

In a second method, the transfer papers 17 stacked in a sheet cassette 24 are fed one by one toward a pair of rollers 26 by means of a pick-up roller 25. The paired rollers 26 have the same function as that of the aforementioned paired rollers 20. After passing through the paired rollers 26, the transfer paper 17 is fed to the resist rollers 23 through guide plates 27, 28, paired feed rollers 50 and guide plates 52, 53, 51. The resist rollers 23 are rotated synchronously with the rotation of the photosensitive drum 11 so that the transfer paper 17 fed to the, photosensitive drum 11 from the resist roller 23 through an upper guide 31 and a lower guide 32 mates with the visualized image on the drum.

As mentioned above, the image on the photosensitive drum 11 is transferred onto the transfer paper 17 by the transfer charger 15. Thereafter, the transfer paper 17 is separated from the drum surface by means of separating charger 33. Then, the transfer paper is fed, through a feeding means 34, to a fixing device 35 including a heating roller 35*a* and a pressure roller 35*b*. The image transferred on the transfer paper 17 is heated and pressurized in the fixing device 35 to be fixed on the transfer paper 17 as a permanent image. Then, the transfer paper 17 is fed to a first ejector or discharge roller 36, from which location the transfer sheet is fed to a second ejector roller 39 through flappers 37 and 38. The transfer paper is ejected from the copying machine by this second ejector roller. Incidentally, in FIG. 2, although the flapper 38 is shown to block a transfer paper feeding path, the flapper 38 is made of light-weighted material and is freely rotatable in a direction shown by an arrow (i.e., in a clockwise direction). Accordingly, when the transfer paper 17 encounters the flapper 38, the latter is pushed up by a leading edge of the transfer paper 17, and thus is rotated in a clockwise direction to a retracted position to permit the passing of the transfer paper.

Further, the above-mentioned copying machine has a both-side copying function and a multiple copying function. Next, fundamental feeding operations regarding the transfer paper in these functions will be explained.

When the both-side (both-surface) copying function is selected in the copying machine, the transfer paper 17 is moved up to the second ejector roller 39 in the same fundamental manner as that mentioned above, meanwhile the image is, transferred onto one surface of the transfer paper 17 and is fixed thereto as mentioned above. While the transfer paper 17 is being ejected from the copying machine, if a predetermined time interval elapses after a trailing edge of the transfer paper 17 is detected by a sheet detecting mechanism comprising a detection lever 40 and a photosensor 41 (i.e., when the trailing edge of the transfer paper 17 has passed the flapper 38), the second ejector roller 39 is rotated in a reverse direction, thus introducing the transfer paper 17 into the copying machine again.

The transfer paper 17 then advances toward the inside of the copying machine with directing the trailing edge thereof in a forward direction, and is guided by the left inclined surfaces of the flappers 38, 37, guide plates 42, 43, 44, 44' and rollers 100 to reach rollers 45. Thereafter, the transfer paper 17 reaches re-feed rollers 47 through rollers 46. At this point, the re-feed rollers 47 are stopped. After the transfer paper completely abuts against the rollers 47, the paired rollers 45, 46 are also stopped, thus waiting for a new copying operation regarding the other surface of the transfer paper 17. When a copy start signal regarding the other surface of the transfer paper 17 is emitted or discharged, the re-feed rollers 47 start to rotate, whereby the transfer paper 17 is fed to the resist rollers 23 through guide plates 48 and 49. Then, a new image is transferred onto the other surface of the transfer paper 17 and is fixed thereto in the same fundamental manner as mentioned above. The transfer paper 17 on both surfaces of which the images are copied is finally ejected from the copying machine by means of the second ejector roller 39.

On the other hand, when the multiple copying function is selected in the copying machine, in a first copying cycle, an image is transferred onto the transfer paper 17 and is fixed thereto in the same fundamental manner as mentioned above. In the multiple copying function, the flapper 37 is positioned in a position shown by a broken line in FIG. 2. Accordingly, the transfer paper 17 fed by the first ejector roller 36 directing the leading edge thereof in a forward direction, is fed to the guide plates 42, 43 along a right inclined surface of the flapper 37, and then is fed to the paired rollers 45 through the guide plates 44, 44' and the paired rollers 100. Thereafter, the transfer paper 17 reaches the pair of re-feed rollers 47 through the paired rollers 46. When a predetermined time period has elapsed after the trailing edge of the transfer paper 17 is detected by the detection lever 40 and the photosensor sensor 41, the flapper 37 is returned, to a position shown by a solid line in FIG. 2. When a second copying signal is emitted, the re-feed rollers 47 start to rotate, whereby the transfer paper 17 is fed to the photosensitive drum 11 in the same manner as in the case of the both-side copying function, wherein a new image is transferred onto the same surface of the transfer paper 17 as the surface on which the image is transferred in the first copying cycle. Thereafter, the transfer paper on the surface of which multiple images are copied is finally ejected from the copying machine by means of the second ejector roller 39.

When the multi-colored image is formed on the transfer paper by using such copying machine, fundamentally, the copying cycles are repeated per the used color toners (developer containers including such color toners). For example, in order to obtain a copied image including three colors of green, red and blue, firstly, an image is formed on the transfer paper 17 with green color toner by using the developer container 13C, then the same transfer paper 17 is fed to the image forming portion (photosensitive drum) again through a transfer paper feeding path shown by a letter A (FIG. 2). Then, the developer container 13C is changed to the developer container 13B, and a new image is formed on the same transfer paper with red color toner. And, similarly, a new image is formed on the same transfer paper with blue color toner (included in the developer container 13D) to complete the three colored image.

While an example of the three colored image being formed on a single transfer paper was explained above, when the same three colored images are to be formed on n (in number) transfer papers, it is necessary to repeat the above-mentioned copying cycles n times in the aforementioned conventional copying machine. Consequently, in the conventional copying machine, the developer containers must be changed three times each time the colored image is formed on the single transfer paper, thus increasing the total copying time.

Conventional copying machines which can obtain a plurality of both side and/or multiple copies by providing an intermediate tray for both-side copying and multiple copying functions have been proposed. However, each of these conventional copying machines is only effective to form two images. Both-side copying function and multiple (only two) copying function, i.e., to form only two images in total, cannot obtain a plurality of copies using the single intermediate tray, where an image is formed in three or more copying cycles, since both a transfer paper used for the next image forming operation and a transfer paper on which the image is already formed used for the next copying cycle, cannot be contained in the same intermediate tray.

In order to solve this problem, a copying machine having a plurality of intermediate trays has been proposed (for example, as disclosed in the Japanese patent Application Laid-Open No. 62-293258). In this conventional copying machine, two (first and second) intermediate trays are provided, and the above-mentioned transfer paper on which, the image is already formed and which is used for the next copying cycle is received in the second intermediate tray, thus preventing the mixing of two kinds of transfer papers, whereby n (in number) colored image can be formed on a single transfer paper or an image can be formed on a single transfer paper in n (in number) copying cycles, for a plurality of transfer papers, thereby reducing the total copying time.

However, in this conventional copying machine, since two intermediate trays are used, the whole copying machine will be large in size and expensive, thus limiting the usage thereof and making wide use thereof difficult.

In such a conventional copying machine, when a plurality of copies are obtained by performing three or more copying cycles for each transfer sheet, the intermediate trays cannot be used and the copying cycles must be repeated for each copy or transfer paper, thus increasing the total copying time. In addition, in the case where different originals are to be used, the originals must be changed per each image forming operation, resulting in making troublesome and increasing the copying time. Further, since the original is repeatedly used, the damage of the originals is not negligible.

In order to eliminate the above-mentioned drawbacks, a copying machine having three or more intermediate trays has been proposed. However, in this case, of course, the whole machine would be large and expensive, thus preventing the wide use thereof.

SUMMARY OF THE INVENTION

The present invention is directed to eliminate the above-mentioned conventional drawbacks.

It is an object of the present invention to provide an image forming apparatus which can perform a plurality of image forming operations on the same sheet, without having a large space for accommodating intermediate trays.

It is another object of the present invention to provide an image forming apparatus which can perform three or more image forming operations on each of a plurality of sheets at high speed.

In order to achieve the above objects, an image forming apparatus according to the present invention comprises an image forming means for forming an image on a sheet, a stacking means for stacking sheets on each of which the image is formed by the image forming means, one after another, with shifting one another by a predetermined amount in a sheet feeding direction, a feeding means for feeding the sheet from the sheet stack formed by the stacking means, one by one, to the image forming means, a conveying means for the sheet stack formed by the stacking means between the stacking means the feeding means, and a control means for controlling the conveying means in such a manner that the sheet stack is conveyed from the feeding means to the stacking means so as to form a sheet stack from the sheets which are fed from the sheet stack by the feeding means and on each of which the image is formed.

DETAILED DESCRIPTION OF THE PREFERRED EMBODIMENTS

Figure 1:
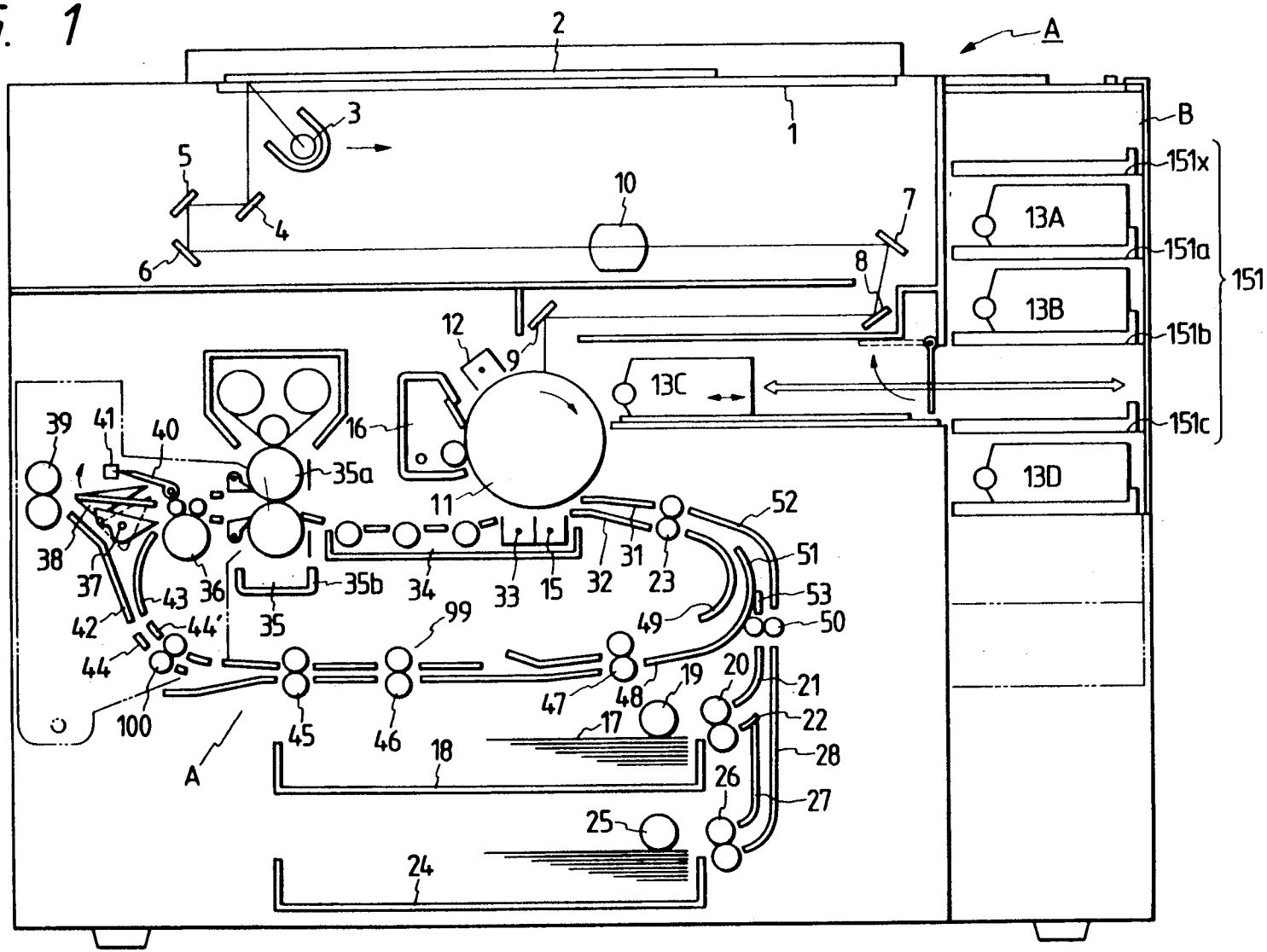
FIG. 1 is a sectional view of an image forming apparatus according to the present invention.

FIG. 1 shows, in section, an image forming apparatus which has a both-side copying function and a multiple copying function with different colors, according to a preferred embodiment of the present invention.

Figure 2:
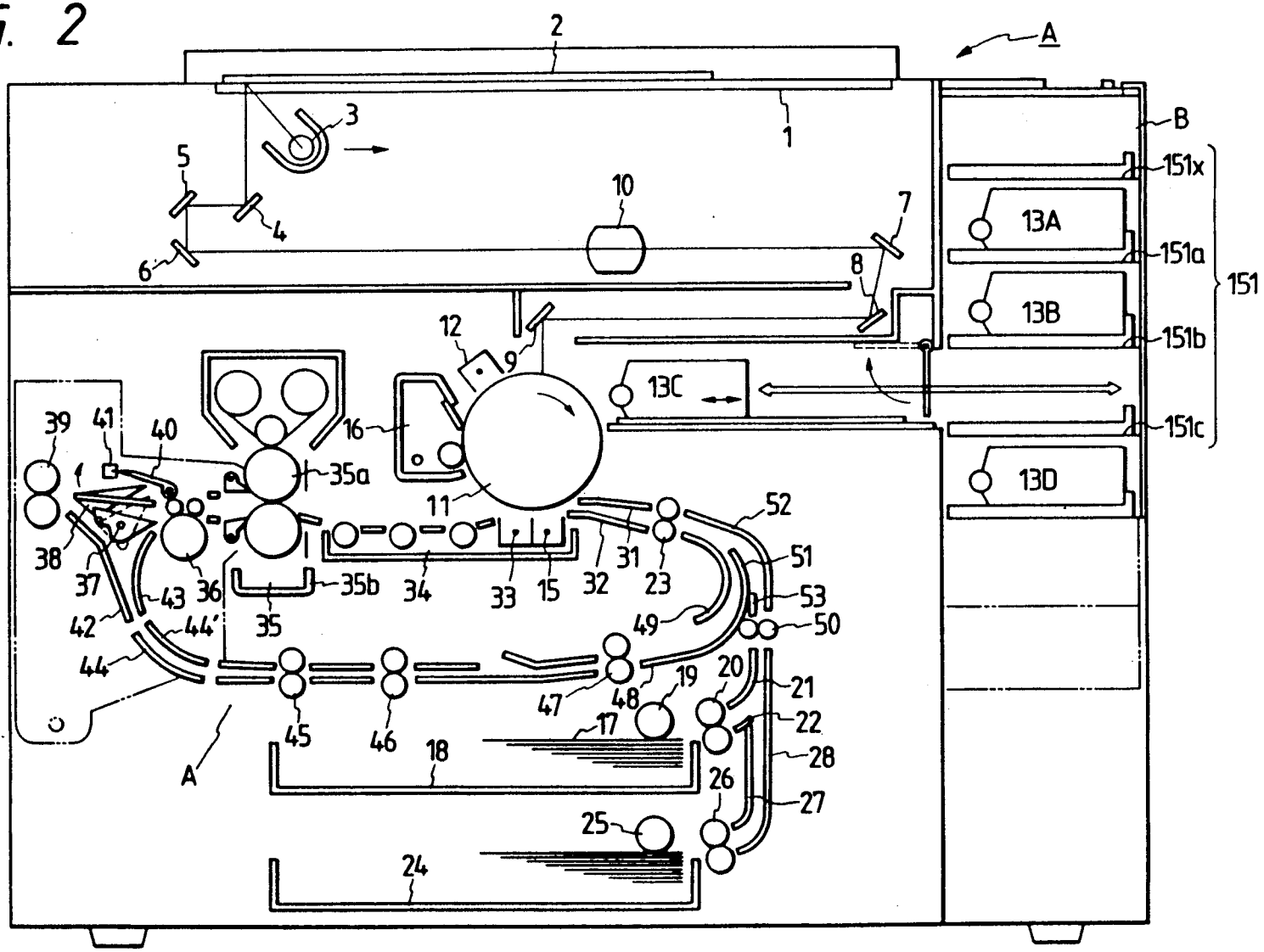
FIG. 2 is a sectional view of a conventional image forming apparatus.

In FIG. 1, constructural elements similar to those shown in FIG. 2 are designated by the same reference numerals and explanation thereof will be omitted. It should be noted that, in this image forming apparatus, the both-side copying function and the multiple copying function regarding a single sheet are performed in the same manner as those in the above-mentioned conventional case (FIG. 2).

Figure 3:
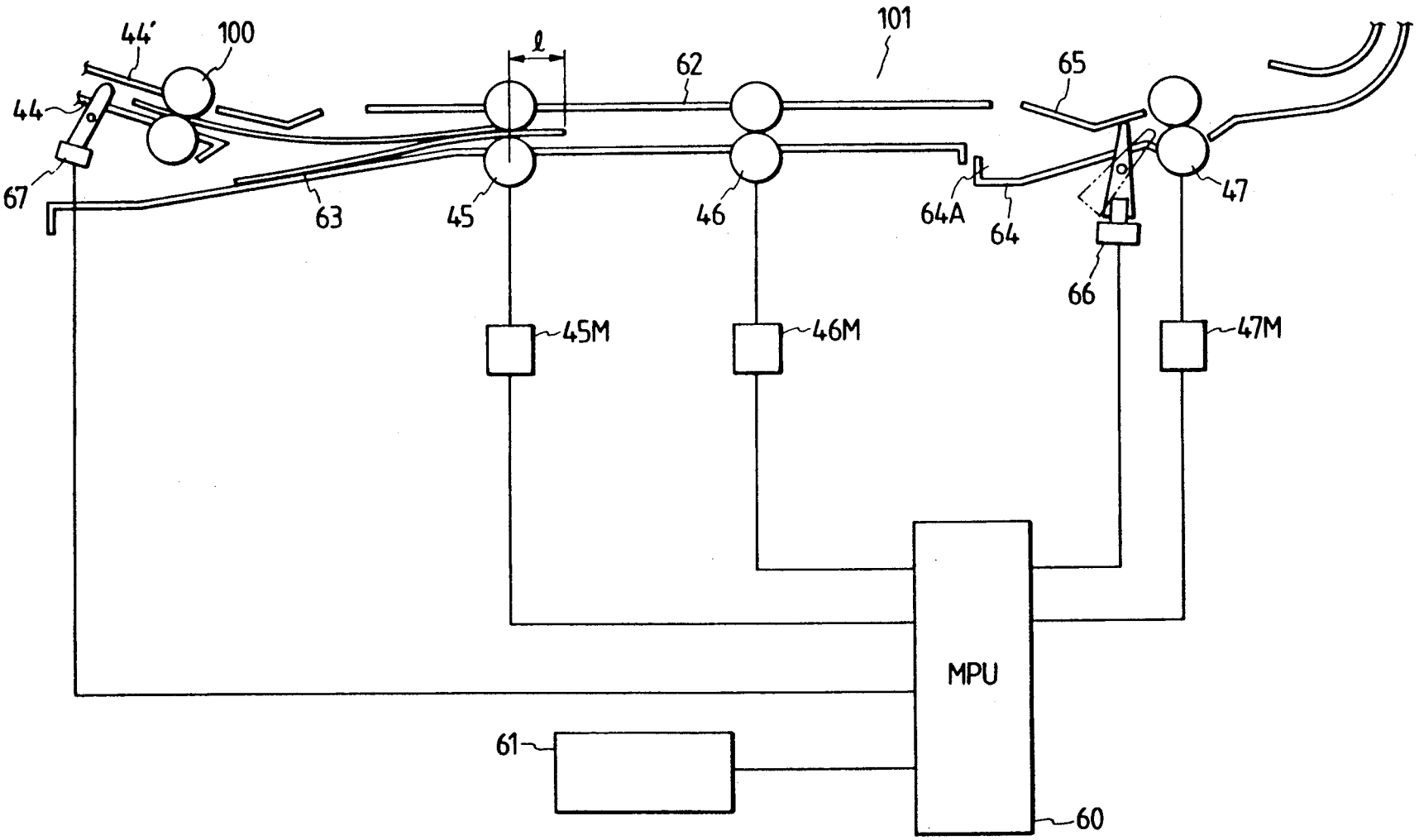
FIG. 3 is a block diagram of a sheet feeding portion of the image forming apparatus according to the present invention.

FIG. 3 shows a block diagram for controlling rollers and sensors arranged in a sheet re-feeding path 99 from rollers 100 to re-feed rollers 47 of FIG. 1.

In FIG. 3, paired rollers 45, 46 and the re-feed rollers 47 are driven by motors 45M, 46M and 47M, respectively, which motors are connected to the corresponding rollers through respective transmission means such as gears (not shown). The motors 45M, 46M and 47M each comprises a reversible stepping motor which can be rotated by a predetermined angle in response to the number of pulses fed from a control circuit 60. A keyboard 61 is used for selecting the number of copies, both-side copying mode, multiple copying mode and the like and for commanding the copy start with respect to the control circuit 60.

Figure 4:
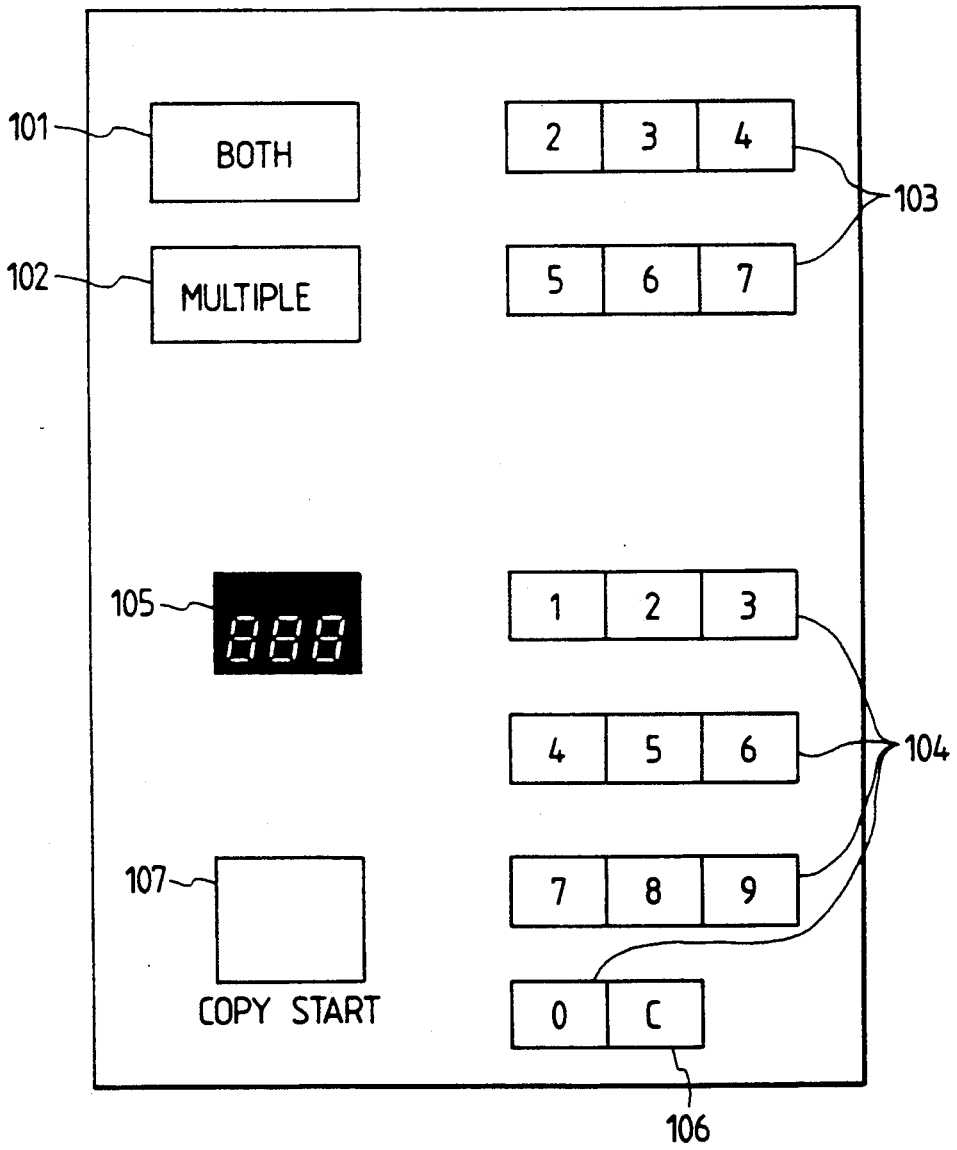
FIG. 4 is a plan view of an operation panel of a keyboard.

FIG. 4 shows a portion of the keyboard. As shown in FIG. 4, the keyboard includes a both-side copying mode designating key 101, a multiple copying mode designating key 102, and keys 103 for designating the number of copying cycles to be effected in the multiple copying mode (i.e., for designating how many times images are overlapped or superimposed). In the illustrated embodiment, 2–7 copying cycles can be designated. However, of course, it should be noted that the designation of the number of the copying cycles is not limited to the above, but the number of the copying cycles may be freely designated by using the ten-key of the keyboard.

The keyboard further includes keys 104 for setting the number of sheets to be copied (i.e., for designating the number of sheets on each of which the same image is formed), a display panel 105 for displaying the designated number of sheets, a clear key 106 for resetting the number displayed on the display panel to "1", and a copy start key 107.

In FIG. 3, the reference numerals 62, 63, 64 and 65 denote guides for guiding the sheet. The guide 64 has a cavity 64A for receiving a loop formed in the sheet when the sheet abuts against the re-feed rollers 47. The reference numerals 66 and 67 denote sensors for detecting the presence of the sheet.

Next, operation up to the image forming will be explained with reference to the flow chart shown in FIG. 5.

In a step S1, the number of images to be superimposed is set or designated by using the keys 103 for designating the number of copying cycles, and, in a step S2, the number of sheets to be copied is,,set by using the copy number setting keys 104. In the next step S3, it is discriminated whether the copy start key 107 is turned ON or not, and if the key 107 was turned ON, the copying operation is started in a step S4.

Next, an operation for containing or receiving a plurality of sheets in the sheet re-feeding path 99 will be explained with reference to the flow chart shown in FIG. 6.

After the both-side copying mode or the multiple copying mode is designated and copy start is instructed by using the keyboard 61 (in the above step S3), the sheet which has been picked up from the sheet cassette 18 or 24 and on one surface of which the image has been formed by the photosensitive drum 11 as mentioned above is fed to the rollers 100 as mentioned above. When a predetermined time period $t_1$ necessary for sending or feeding a leading edge of the sheet to the nip between the paired rollers 45 after the leading edge of the sheet is detected by the sensor 67 (in a step S11 of FIG. 6) is elapsed (in a step S12), the motor 45M is started to rotate (in a step S13). The motor 45M is rotated for a time period t2 necessary for feeding the sheet from the nip between the paired rollers 45 by a predetermined distance l (in a step S14), and thereafter, the motor 45M is stopped (in a step S15).

Incidentally, the rotation of the paired rollers 45 can also be controlled by the number of pulses fed from the control circuit to the motor 45M in such a manner that the control circuit feeds, to the motor, the number of pulses corresponding to a rotation angle of the motor necessary for feeding the sheet from the nip between the paired rollers 45 by the predetermined distance l.

Figure 7:
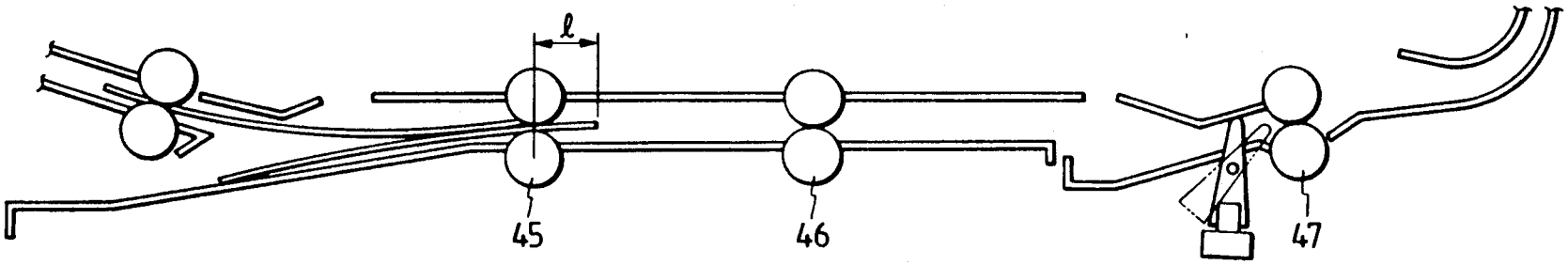
FIGS. 7 and 8 are explanatory views for explaining a sheet stacking operation.
Figure 8:
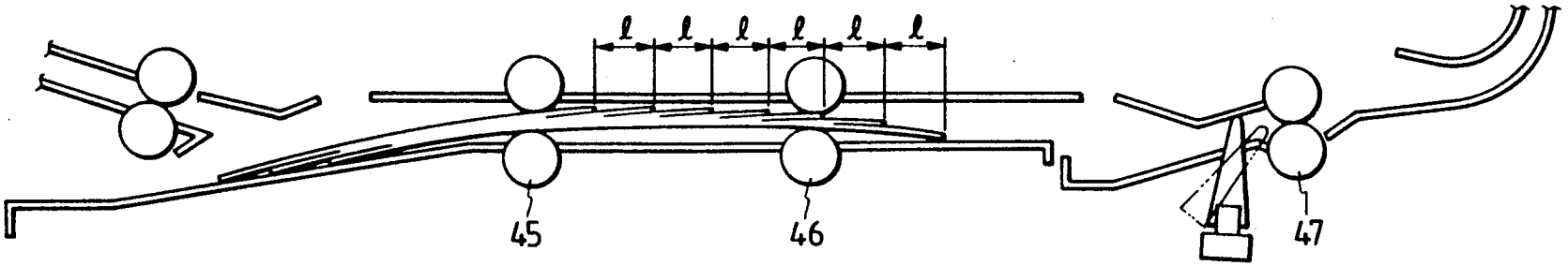

Next, in step S16, it is discriminated whether the designated number of sheets have been stacked or not, and if NO, the sequence is returned to the step S11. Then, the next sheet is fed. After the next sheet reaches the paired rollers 45, the next sheet is fed by the predetermined distance l in the same manner as mentioned above (see FIG. 7), by means of the paired rollers 45. In this way, the two sheets are stacked with shifting by the distance l from one another. By repeating such operations by times corresponding to the designated number of the sheets, the sheets can be stacked one after with shifting by the distance ( one another, as shown in FIG. 8.

Next, an operation for re-feeding the stacked sheets for use in the both-side copying mode (image formation on the back surface of the sheet) or in the multiple (twice) copying mode (second copying cycle) will be explained with reference to the flow charts shown in FIGS. 9 and 10.

Figure 9:
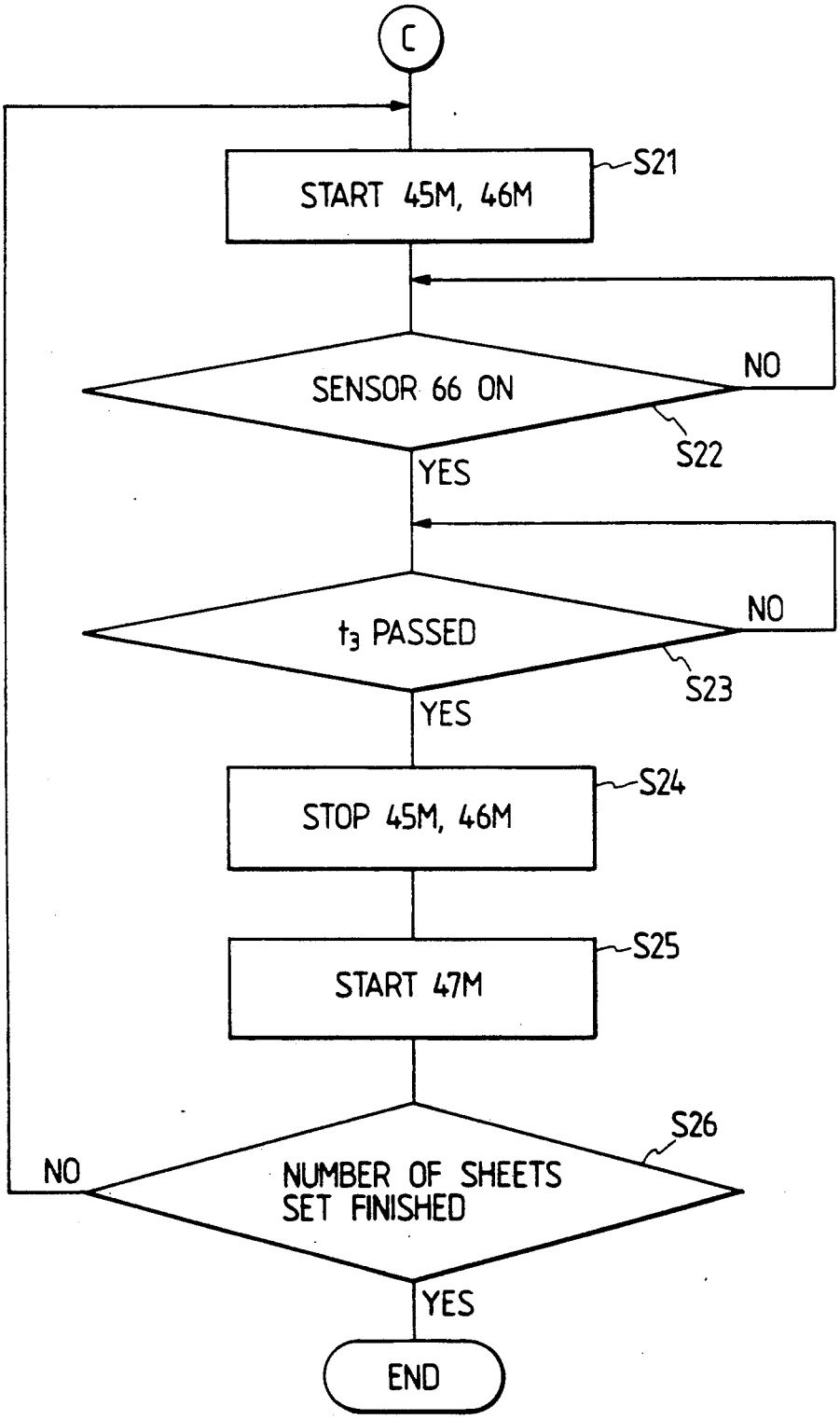
FIG. 9 is a flow chart for re-feeding the sheet.
Figure 10:
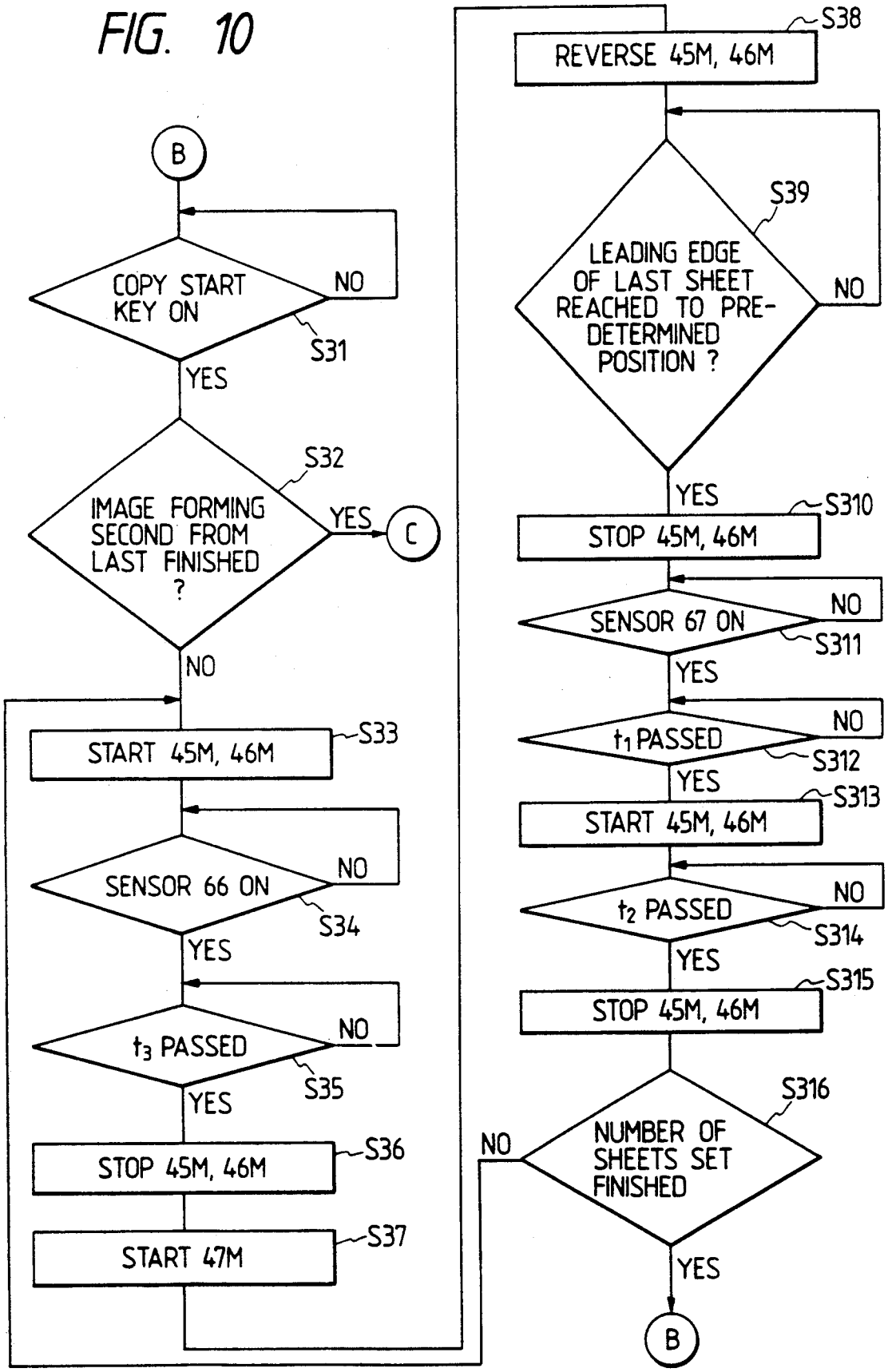
FIG. 10 is a flow chart for stacking the re-feed sheets.
Figure 11:
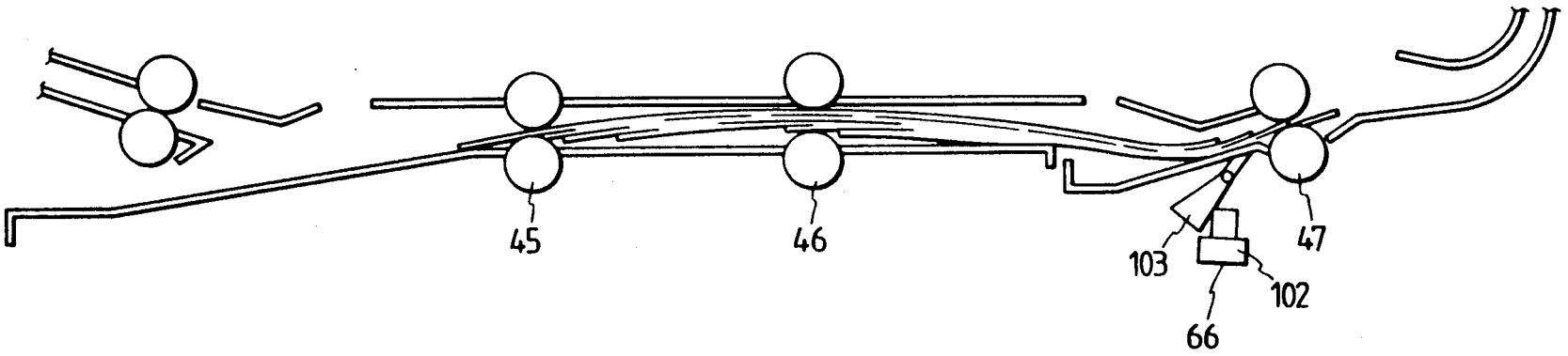
FIGS. 11 and 12 are explanatory views for explaining a sheet processing operation.

In the step S16 of FIG. 16, when it is discriminated that the designated number of sheets has been stacked, the sequence goes to a step S31 of FIG. 10, where the operation is in a waiting condition for replacement of the originals and/or developer containers until the copy start key 107 is turned ON. When the copy start key 107 is turned ON, in a step S32, it is discriminated whether the last image forming operation has been completed or not. Since the step S32 shows affirmative in the both-side copying mode or the twice copying mode, the sequence goes to the flow chart of FIG. 9.

In a step S21 of FIG. 9, the motors 45M and 46M are started to rotate, thus feeding the stacked sheets to the re-feed rollers 47. When the trailing edge of the foremost sheet has just passed through the paired rollers 46, the motors 45M and 46M are stopped (in a step S24). This timing is determined (in a step S23) by the time elapsed after the leading edge of the foremost sheet is detected by the sensor 66 (in a step S22). Next, in a step S26, the motor 47M is driven to rotate the lower roller in the paired rollers 47, thus feeding the lowermost (i.e., foremost) sheet. In this case, since the remaining sheets are maintained stationary while being pinched by the stopped roller pairs 45 or 46, the foremost sheet can be separated from the remaining sheets.

Accordingly, by holding the remaining sheets by stopping the paired rollers 45 and 46, only the lowermost sheet can be fed. By repeating such operation by times corresponding to the designated number of the sheets, the sheets can be fed one by one from the sheet stack.

In performing two image forming operations regarding a single sheet in the both-side copying mode or the multiple copying mode, after the second image forming operation is completed, the sheet is ejected from the image forming apparatus through the medium of the first and second ejector rollers 36, 39, thus completing a series of copying operations.

Next, a sequence for performing three or more image forming operations regarding a plurality of sheets, for example, to obtain a copied image superimposed with three or four colors will be explained with reference to the flow chart shown in FIG. 10.

Figure 5:
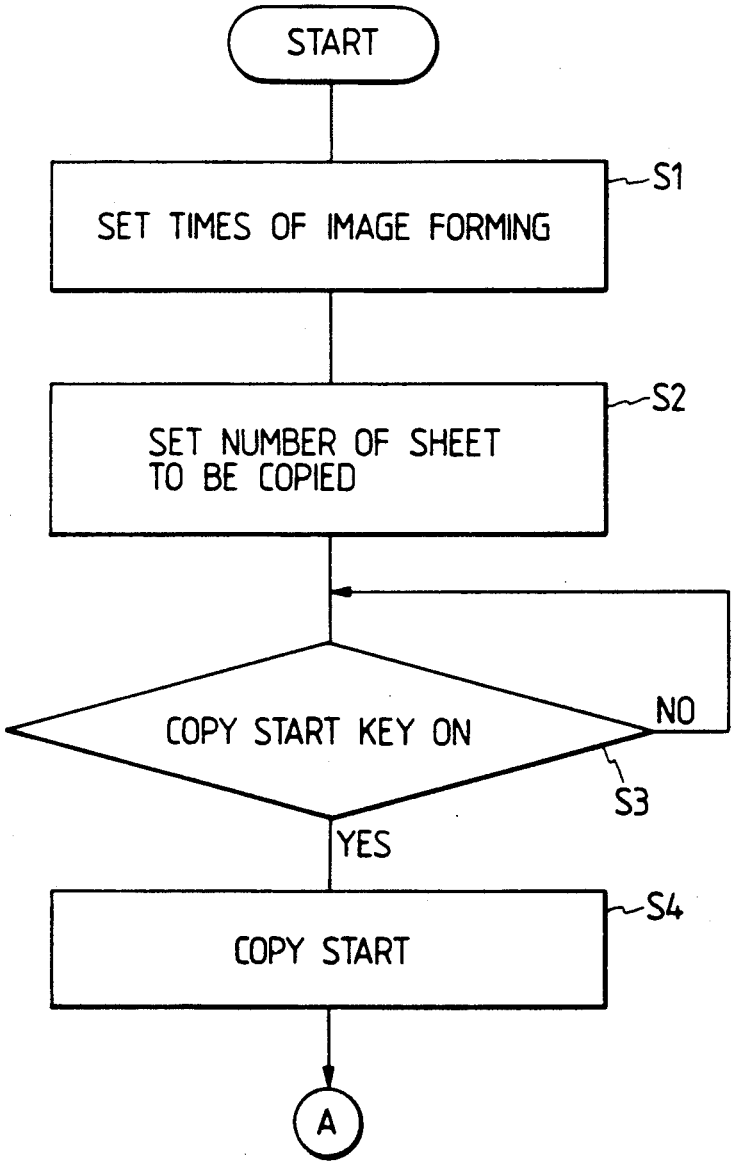
FIGS. 5 and 6 are flow charts for stacking a sheet.
Figure 6:
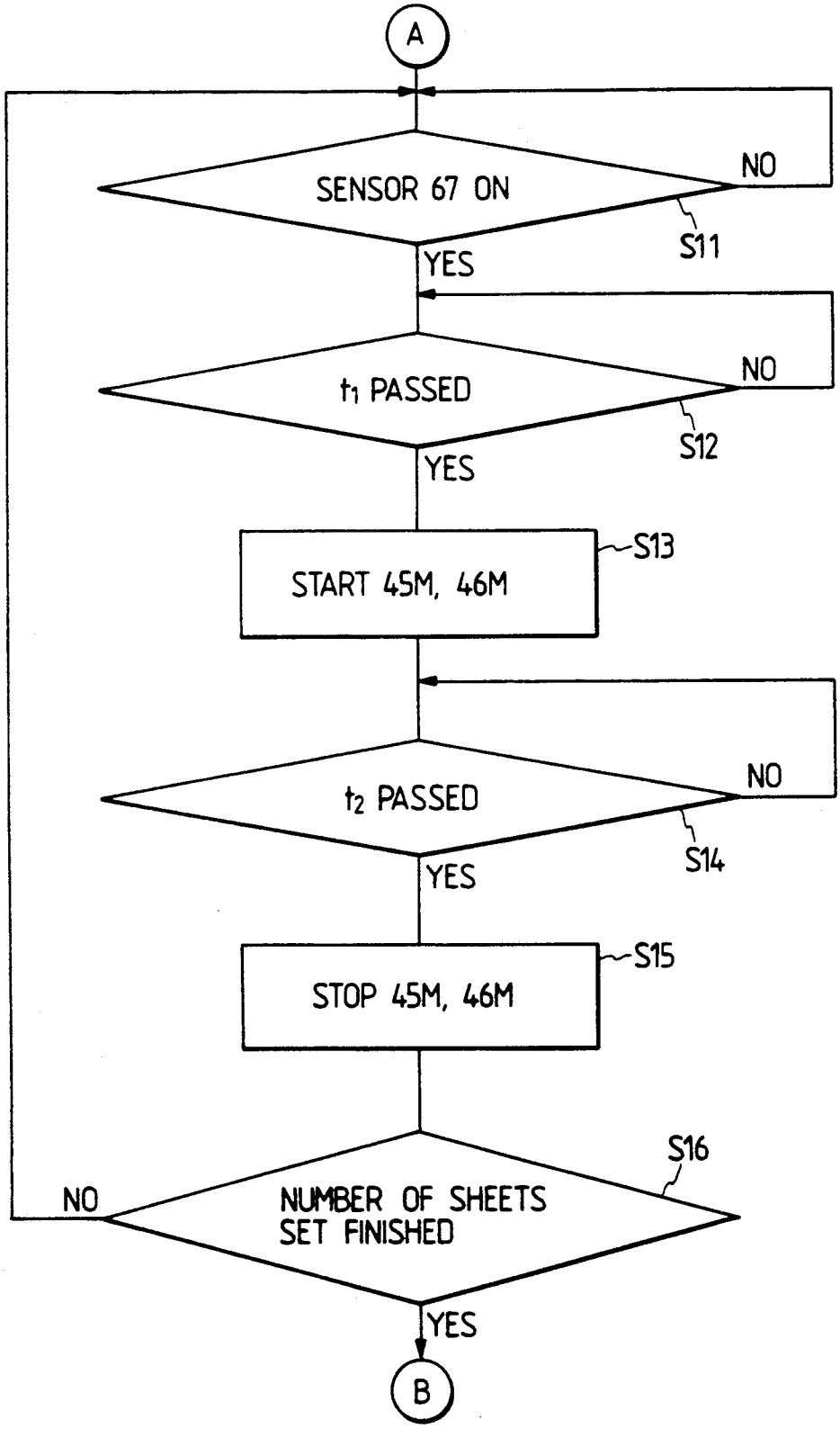

The sequence advances in accordance with the flow charts of FIGS. 5 and 6 until the plurality of sheets are stacked as shown in FIG. 8 after the first image forming operation is completed.

Next, when the copy start is commanded by using the keyboard 61 (in a step S31), in a step S32, it is discriminated or judged whether the last but one image forming operation has been completed or not. If the last but one image forming operation has been completed and when the next operation is the last image forming operation, the sheets are fed in accordance with the flow chart of FIG. 9, and the sheets on which the complete image has been copied are ejected from the image forming apparatus by means of the second ejector roller 39. Incidentally, whether the next operation is the last image forming operation or not can be judged by comparing the number of the image forming operations (to be repeated) inputted in the control circuit 60 from the keyboard 61 with the repeated number of completed image forming operations counted by the control circuit 60.

When it is judged that the next operation is not the last or final image forming operation, i.e., when the sheets are to be fed to the sheet re-feeding path 99 for repeating the image forming operation, the sequence goes to a step S33, where the whole stacked sheets are fed by the paired rollers 45 and 46. When a predetermined time period $t_3$ elapses after the leading edge of the foremost sheet is detected by the sensor 66 (in a step S34), i.e., when the leading edge of the foremost sheet abuts against the nip between the re-feed rollers 47 and the trailing edge thereof has just passed through the paired rollers 46, the paired rollers 45 and 46 are stopped (in a step S36), and the re-feed rollers 47 are rotated in a normal direction, thus feeding only the foremost or lowermost sheet (in a step S37).

Figure 12:
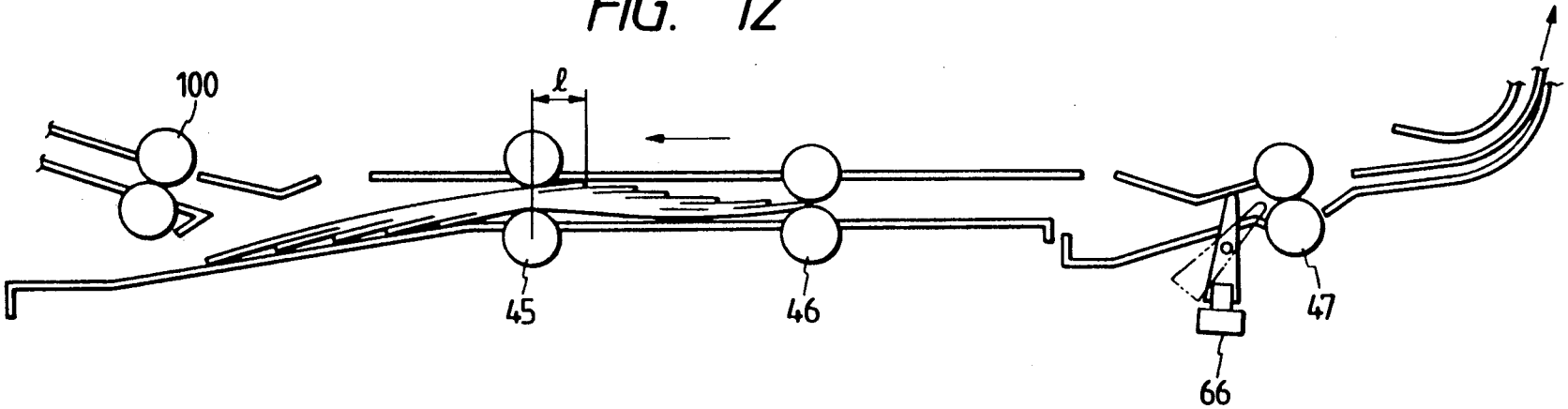

Next, in a step S38, the paired rollers 45 and 46 are rotated in a reverse direction, thus returning the whole remaining stack of sheets in an upstream direction (shown by an arrow in FIG. 12). Then, when the leading edge of an uppermost sheet is shifted by the predetermined distance l from the paired rollers 45 in a downstream direction as shown in FIG. 12 (in a step S39), the paired rollers 45 and 46 are stopped (in a step S310), thus waiting until the fed sheet is copied and is returned to the sheet re-feeding path. When the leading edge of the fed sheet passes through the sensor 67 (in a step S311) and reaches to the nip between the paired rollers 45 (in a step S312), the paired rollers 45 and 46 are rotated by the predetermined amount (in steps S313, S314 and S315), thus overlapping the returned sheet on the uppermost sheet while shifting the leading edge of the returned sheet by the distance l in the upstream direction with respect to the uppermost sheet. When such operations are repeated by times corresponding the number of firstly tacked sheets (in a step S316), the second image forming operation regarding all of the sheets is finished, and all of the sheets are again in the stacked condition shifted by the predetermined distance l from one another, as shown in FIG. 8. Then, the sequence returns to the step S312. And, as mentioned above, the third image forming operation can be started by feeding the lower-most sheet in the sheet stack to the photosensitive drum.

Further, here, if the transfer sheets on which the image is formed by the third image forming operation are directed to the paired rollers 45 in the same manner as mentioned above, the fourth image forming operation can be performed. In this way, n (in number) image forming operations on the single sheet can be performed with respect to a plurality of sheets successively.

In the illustrated embodiment, it is necessary to shift the sheet stack so that the leading edge of the uppermost sheet is positioned forwardly of the paired rollers 45 with spacing the predetermined distance l therefrom and the trailing edge of the lowermost sheet is positioned just behind the paired rollers 46. To this end, as mentioned above, the paired rollers 45 and 46 are driven by the respective stepping motors each of which is reversible and can be controlled to rotate by a desired rotation angle corresponding to a desired feeding distance for the sheets. By counting the number of pulses fed to the stepping motors for feeding the sheets in the normal or reverse direction between the step S34 of FIG. 10 to the step S39, the present position of the sheets can be determined.

In the illustrated embodiment, the sheets on which the image is formed in the second image forming operation are stacked successively on the stacked sheets on which the image is formed in the first image forming operation, with shifting by the predetermined distance from one another. Accordingly, the first sheet on which the image is formed in the second image forming operation is overlapped on the uppermost sheet (the last sheet) of the stacked sheets on each of which the first image is formed and which wait for the second image forming operation, with shifting by the distance l from one another.

Therefore, in order to feed all of the sheets on which the first image is formed to the sheet re-feeding path for use in the second image forming operation, the number of the firstly stacked sheets is previously stored or memorized, and the feeding operations are repeated by times corresponding to the memorized number. In this case, if double feed of the sheets occurs in the sheet feeding operation due to any trouble, there will arise a difference between the memorized number and the number of sheets actually fed. That is to say, there is a danger that the sheet on which the second image has already been formed is erroneously detected as the last sheet for the second image forming operation and such sheet is fed for the second image forming operation.

Figure 13:
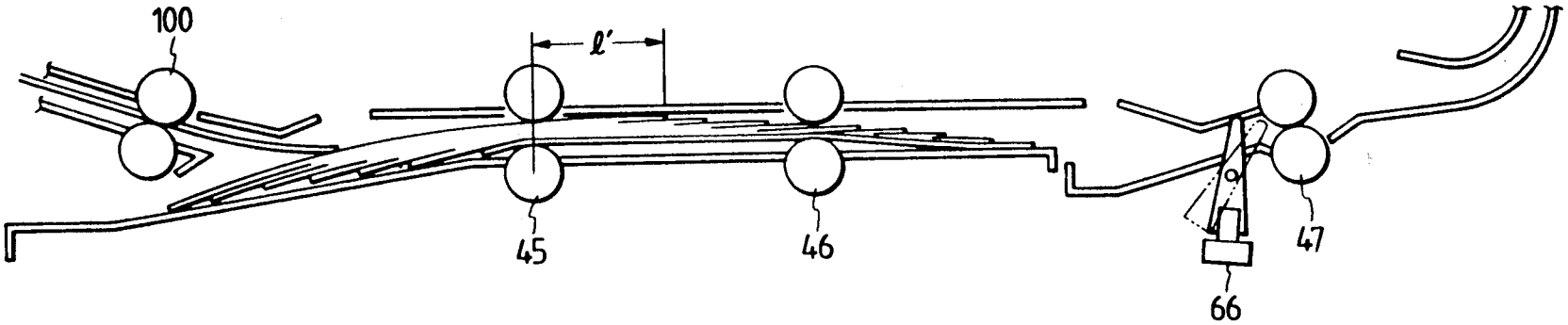
FIGS. 13 to 15 are explanatory views for explaining sheet processing operations in image forming apparatus according to other embodiments of the present invention.
Figure 14:
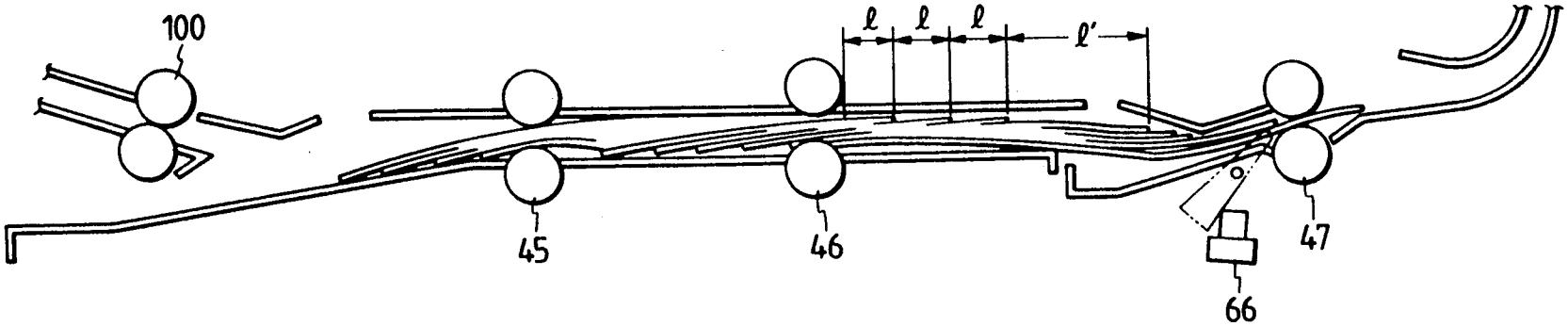

To avoid this, in an embodiment which will be described below, the sheet stack including the sheets on which the image is formed is overlapped on the sheet stack being fed, with shifting by a distance larger than the predetermined distance l (between the sheets) from one another, thus separating two kinds of sheet stacks from each other. In this method, before the first sheet on which the image is formed is overlapped on the sheet stack to be fed from now, the leading edge of the uppermost sheet of such sheet stack is previously positioned downstream of the paired rollers 45 with spacing therefrom by a distance l' larger than the distance l (FIGS. 13, 14). Accordingly, the first sheet will be overlapped on the sheet stack with shifting by the distance l' with respect to the uppermost sheet of the sheet stack. Next, the second sheet is overlapped on the first sheet with shifting by the distance l one from another, and third, fourth, . . . final sheets are similarly overlapped on the previous sheet with shifting by the distance l from one another.

With this arrangement, even if the double feed of the sheets occurs in the sheet feeding operation to cause the difference between the memorized number and the number of sheets actually fed, since the second sheet stack including the sheets on which the second image is formed is spaced apart from the first sheet stack to be fed for the second image forming operation by the distance l', the second sheet stack does not come into the feeding condition (i.e., the lowermost sheet of the second sheet stack does not reach the paired rollers 46) immediately after the first sheet stack is emptied. Accordingly, in this condition, if the re-feed rollers 47 are driven, the second sheet stack is not fed because it is held stationary by the stopped rollers 46. In this way, the erroneous feeding of the sheet can be prevented. Further, if it is so designed that the boundary between the first and second sheet stacks can be detected by the sensor 66, the erroneous feeding of the sheet will be further positively prevented.

Figure 15:
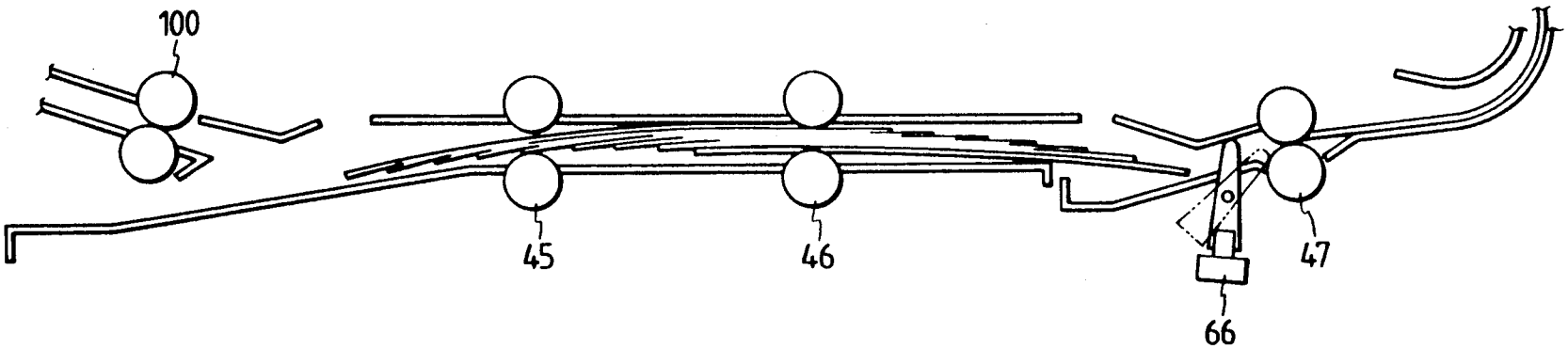

More particularly, as shown in FIG. 15, by arranging the sensor 66 to position between the distance l' between the first and second sheet stacks, the condition that the first sheet stack is emptied can be detected.

In the illustrated embodiment, while the boundary between the sheet stacks was detected by the sensor 66 provided for detecting the leading edge of the sheet, the number of the sensors and/or the position thereof are not limited to the illustrated embodiments.

Further, in the illustrated embodiments, while two pairs of rollers 45, 46 were used for forming and shifting the sheet stack, the number of pairs of rollers is not limited to two. For example, only one pair of rollers may be used in the smaller image forming apparatus, and three or more pairs of rollers may be used in the larger image forming apparatus.

Lastly, in the illustrated embodiments, while the present invention was applied to the copying machine, it should be noted that the present invention is not limited to the copying machine, but can be applied to the image forming apparatuses which can output the image on the sheet, such as a printer, facsimile, plotter and the like.

I claim:

1. A sheet conveying apparatus, comprising:

first conveying means for holding a sheet stack in which sheets are stacked offset from adjacent sheets by a predetermined distance in a sheet conveying direction and conveying the stack in a conveying direction and a direction reverse thereto;

second conveying means for conveying the sheet to be held on said first conveying means and offset stacking the sheet;

feeding means disposed downstream of said first conveying means in the sheet conveying direction, for feeding out the sheet from the stack held in said first conveying means; and controlling means for controlling said first and second conveying means so that the stack is conveyed in the reverse direction in order to offset stack the sheet conveyed by said second conveying means on the stack after the sheet is fed by said feeding means.

2. A sheet feeding apparatus according to claim 1, wherein said first conveying means includes a tray on which the sheets are stacked.

3. A sheet feeding apparatus according to claim 1, wherein said first conveying means has conveying rotary members for feeding a sheet together with the previously fed sheets each time when the sheet is fed thereto.

4. A sheet feeding apparatus according to claim 1, wherein said feeding means feeds the sheet while pinching said sheet therebetween.

5. A sheet feeding apparatus according to claim 4, wherein said feeding means includes a pair of feeding rotary members for pinching the sheet therebetween.

6. A sheet feeding apparatus according to claim 1, wherein first conveying means conveys the sheet while pinching said sheet therebetween.

7. A sheet feeding apparatus according to claim 6, wherein said first conveying means includes a pair of feeding rotary members for pinching the sheet therebetween.

8. A sheet feeding apparatus according to claim 6, wherein said control means controls said first conveying means in such a manner that, when the sheet is fed, said first conveying means conveys said sheet stack to said feeding means until a sheet in said stack nearest to said feeding means is released from a pinched condition by means of said first conveying means.

9. A sheet feeding apparatus according to claim 8, wherein, when the sheet is fed, said first conveying means pinches the sheets other than a sheet to be fed by said feeding means.

10. An image forming apparatus, comprising:

image forming means for forming an image on a sheet;

first conveying means for holding a sheet stack in which sheets are stacked offset from adjacent sheets by a predetermined distance in a sheet conveying direction and conveying the stack in a conveying direction and a direction reverse thereto;

second conveying means for conveying the sheet on which an image is formed by said image forming means to be held on said first conveying means and offset stacking the sheet;

feeding means disposed downstream of said first conveying means in the sheet conveying direction, for feeding out the sheet from the stack held in said first conveying means; and controlling means for controlling said first conveying means so that the stack is conveyed in the reverse direction in order to stack the sheet conveyed by said second conveying means offset to adjacent sheets after the sheet is fed by said feeding means.

11. An image forming apparatus according to claim 10, wherein said first conveying means has conveying rotary members for feeding the sheet together with the previously fed sheets each time when the sheet is fed thereto.

12. An image forming apparatus according to claim 10, wherein said feeding means feeds the sheet while pinching said sheet therebetween.

13. An image forming apparatus according to claim 12, wherein said feeding means includes a pair of feeding rotary members for pinching the sheet therebetween.

14. An image forming apparatus according to claim 10, wherein said first conveying means conveys the sheet while pinching said sheet therebetween.

15. An image forming apparatus according to claim 14, wherein said control means controls said first conveying means in such a manner that said first conveying means conveys said sheet stack to said feeding means until a sheet in said stack nearest to said feeding means is released from a pinched condition by means of said conveying means, to feed the sheets by means of said feeding means.

16. An image forming apparatus according to claim 15, wherein, when the sheet is fed, said conveying means pinches the sheets other than a sheet to be fed by said feeding means.

17. An image forming apparatus according to claim 15, wherein said first and second conveying means hold conveying rotary members rotatable while pinching the sheet therebetween in common.

18. An image forming apparatus according to claim 10, further comprising a conveying path for introducing the sheet fed by said feeding means to said image forming means for the image formation.

19. A sheet conveying apparatus, comprising:

conveying means for conveying a sheet in predetermined direction;

a tray for stacking the sheet conveyed by said conveying means;

moving means for moving the sheet stacked on said tray, to offset the sheet conveyed by said conveying means in relation to a sheet previously stacked on said tray with shifting by predetermined distance in the predetermined direction with respect to the previously stacked sheet;

feeding means for feeding the sheet from a sheet stack obtained by stacking the sheets offset by the predetermined distance; and controlling means for controlling said moving means so that the sheet stack is moved from first position where the sheet is supplied by said feeding means to second position where the sheet being conveyed by said conveying means in order to stack the sheet conveyed by said conveying means on the sheet stack after the sheet is fed by said feeding means offset from one another.

20. A sheet feeding apparatus according to claim 19, wherein said moving means moves a sheet together with sheets previously stacked and moved by the predetermined distance, each time when the sheet is stacked on said tray.

21. A sheet feeding apparatus according to claim 19, wherein said moving means moves the sheet in said predetermined direction by a first predetermined distance until a trailing edge of said sheet passes through said conveying means, and thereafter, returns said sheet in a reverse direction by a second predetermined distance shorter than said first predetermined distance.

22. A sheet conveying method, comprising steps of:

taking out a first sheet from a stack of sheets, said sheets being stacked offset from one another by a predetermined distance in a sheet conveying direction;

conveying the remainder of said stack in a direction reverse to the conveying direction and stopping said conveyance when said stack reaches a predetermined position; and offset stacking the sheet by the predetermined distance relative to the last sheet of said stack.

23. An image forming method, comprising steps of:

forming a stack of sheets on which images are formed wherein said sheets are offset from one another by a predetermined distance in a sheet conveying direction;

conveying the sheet stack in a conveying direction to move said stack to a sheet taking out position;

taking out the first sheet in the conveying direction of the stack fed to the taking out position;

forming an image on the sheet taken out;

conveying the stack in direction reverse to the conveying direction;

stacking the sheets taken out and having the image thereon offset from one another on the last sheet of stack which is reversely fed.

* * * * *

UNITED STATES PATENT AND TRADEMARK OFFICE

CERTIFICATE OF CORRECTION

PATENT NO. : 5,090,674

DATED : February 25, 1992

INVENTOR(S) : TAKASHI OZAWA

It is certified that error appears in the above-identified patent and that said Letters Patent is hereby corrected as shown below:

IN THE DRAWINGS

Figure 5, S2, "SHEET" should read --SHEETS--.

COLUMN 1

Line 16, "is" (2nd occurrence) should be deleted.
Line 63, "separate," should read --separate--.

COLUMN 2

Line 11, "the," should read --the--.
Line 18, "a" should be deleted.
Line 46, "is," should read --is--.

COLUMN 3

Line 27, "returned," should read --returned--.

UNITED STATES PATENT AND TRADEMARK OFFICE

CERTIFICATE OF CORRECTION

PATENT NO. : 5,090,674

DATED : February 25, 1992

INVENTOR(S) : TAKASHI OZAWA

It is certified that error appears in the above-identified patent and that said Letters Patent is hereby corrected as shown below:

COLUMN 4

Line 9, "used" should be deleted.
Line 17, "which," should read --which--.
Line 65, "with" should read --and--.

COLUMN 5

Line 2, "means" (second occurrence) should read --means and--.

COLUMN 6

Line 25, "is,,set" should read -- is set--.

Line 47, "period t2" should read --period $T_2$--.

COLUMN 7

Line 1, "distance (" should read --distance $\ell$ from--.

UNITED STATES PATENT AND TRADEMARK OFFICE

CERTIFICATE OF CORRECTION

PATENT NO. : 5,090,674

DATED : February 25, 1992

INVENTOR(S) : TAKASHI OZAWA

It is certified that error appears in the above-identified patent and that said Letters Patent is hereby corrected as shown below:

COLUMN 8

Line 37, "corresponding" should read --corresponding to--.

Line 38, "tacked" should read --stacked--.

COLUMN 11

Line 48, "conveying" should read --first conveying--.

COLUMN 12

Line 59, "of" should read --of the--.

Signed and Sealed this

Twenty-fifth Day of January, 1994

Bruce Lehman

*Attest:*

BRUCE LEHMAN

*Attesting Officer*

*Commissioner of Patents and Trademarks*